US005359796A

United States Patent [19]

Werling

[11] Patent Number: 5,359,796

[45] Date of Patent: Nov. 1, 1994

[54] ROOF SUPPORTED DISPLAY

[75] Inventor: John M. Werling, Las Vegas, Nev.

[73] Assignees: Roy N. Brown; Charles A. Codding, Oklahoma County, Okla.

[21] Appl. No.: 217,302

[22] Filed: Mar. 24, 1994

Related U.S. Application Data

[63] Continuation of Ser. No. 76,306, Jun. 11, 1993, Pat. No. 5,307,577, which is a continuation of Ser. No. 31,079, Mar. 10, 1993, abandoned, which is a continuation of Ser. No. 731,165, Jul. 15, 1991, abandoned.

[51] Int. Cl.[5] ..... G09F 11/18

[52] U.S. Cl. ..... 40/514; 40/592

[58] Field of Search ..... 40/514, 592; 160/133, 160/201; 52/103, 105

[56] References Cited

U.S. PATENT DOCUMENTS

| | | | |
|---|---|---|---|
| 981,184 | 1/1911 | Fitch . | |
| 1,102,921 | 7/1914 | Hodges . | |
| 1,231,455 | 6/1917 | Thole . | |
| 1,649,943 | 11/1927 | Boeck | 160/133 X |
| 1,796,233 | 3/1931 | Barns | 52/105 X |
| 1,853,704 | 4/1932 | Standow . | |
| 2,506,209 | 5/1950 | Glass . | |
| 3,732,913 | 5/1973 | Wrono | 160/133 |
| 3,761,890 | 9/1973 | Fritts et al. . | |
| 3,938,269 | 2/1976 | Catteau . | |
| 4,345,392 | 8/1982 | Cornell | 40/514 X |
| 4,651,940 | 3/1987 | Nakamura . | |
| 4,679,822 | 7/1987 | Wolfe . | |
| 4,691,753 | 9/1987 | Baier | 160/133 X |
| 4,817,318 | 4/1989 | Strauch . | |
| 4,825,571 | 5/1989 | Jennings | 40/514 X |
| 4,951,730 | 8/1990 | Hsu et al. . | |
| 5,307,577 | 5/1994 | Werling | 40/514 |

*Primary Examiner*—Kenneth J. Dorner
*Assistant Examiner*—Joanne Silbermann
*Attorney, Agent, or Firm*—Dunlap, Codding & Lee

[57] ABSTRACT

A display supported on the roof comprising a case and a flexible panel. House number indicia is on the panel. The case is connected to the roof of a house structure and the panel is movable from a storage position wherein the panel is disposed in the case to a display position wherein the panel extends a distance from the space so that the house number indicia is observable or visible from a position above the roof.

2 Claims, 3 Drawing Sheets

ROOF SUPPORTED DISPLAY

This application is a continuation of U.S. Ser. No. 08/076,306, filed Jun. 11, 1993 now U.S. Pat. No. 5,307,577, which is a continuation of U.S. Ser. No. 08/031,079, filed Mar. 10, 1993, now abandoned, which is a continuation of U.S. Ser. No. 07/731,165, filed Jul. 15, 1991, now abandoned.

FIELD OF THE INVENTION

The present invention relates generally to displays and, more particularly, but not by way of limitation, to a display for displaying house number indicia supported on the roof of a house structure.

DESCRIPTION OF THE PREFERRED EMBODIMENTS

Figure 1:
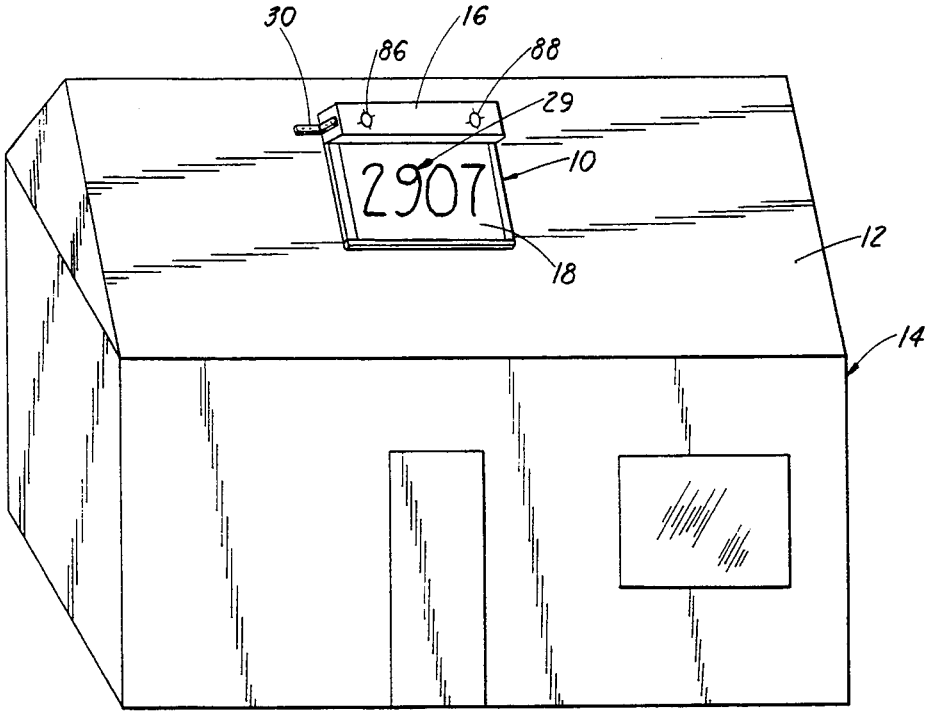
FIG. 1 is a diagrammatic, perspective view of a house structure having a display constructed in accordance with the present invention supported on a roof of the house structure.

As shown in FIG. 1, the present invention comprises a display 10 which is supported on a roof 12 of a house structure 14. The term "house structure" as used herein means a residential or commercial dwelling.

In many instances, it becomes important that ones house number is identifiable and observable or visible from a position above the roof 12 of the house structure 14. For example, if an emergency situation exists in the house structure 14 such as a robbery or medical emergency, it is difficult for helicopters to assist emergency vehicles at the street level in locating the particular house structure unless the house number indicia is observable from a position above the roof 12 of the house structure 14. The display 10 is constructed to display the house number of a house structure from a position above the roof 12 of the house structure 14.

Figure 2:
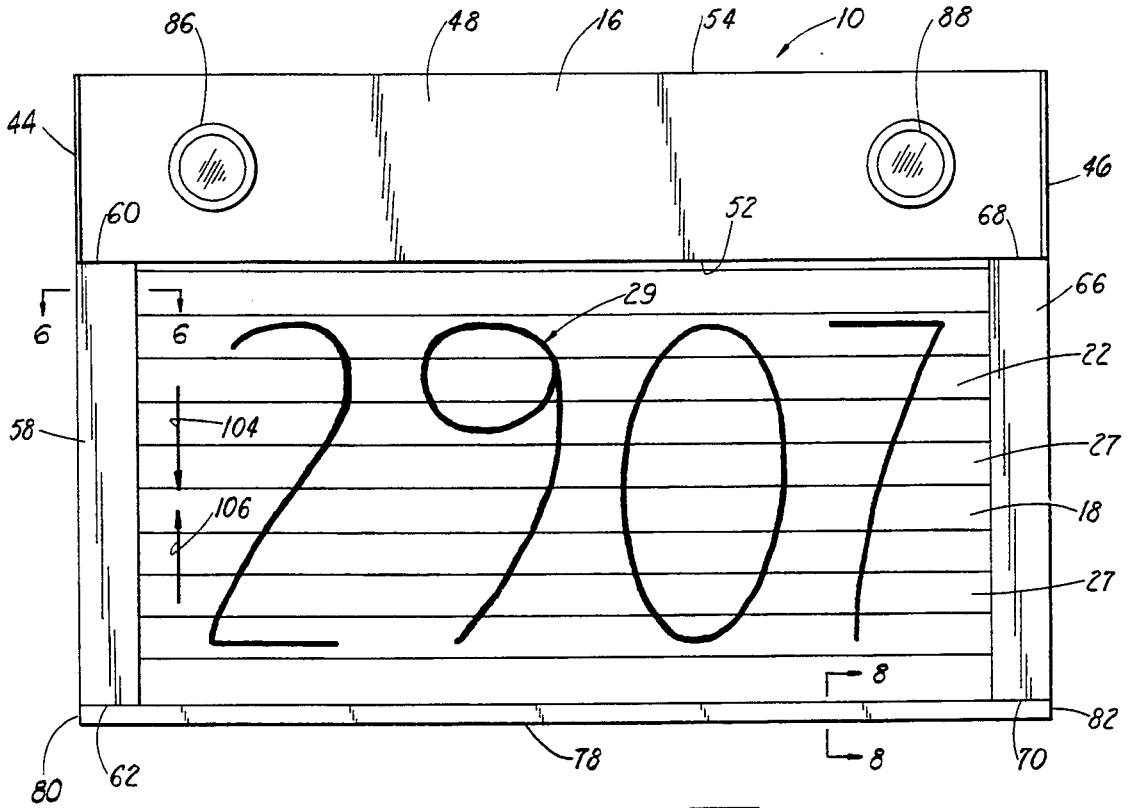
FIG. 2 is a top elevational view of the display of FIG. 1.
Figure 3:
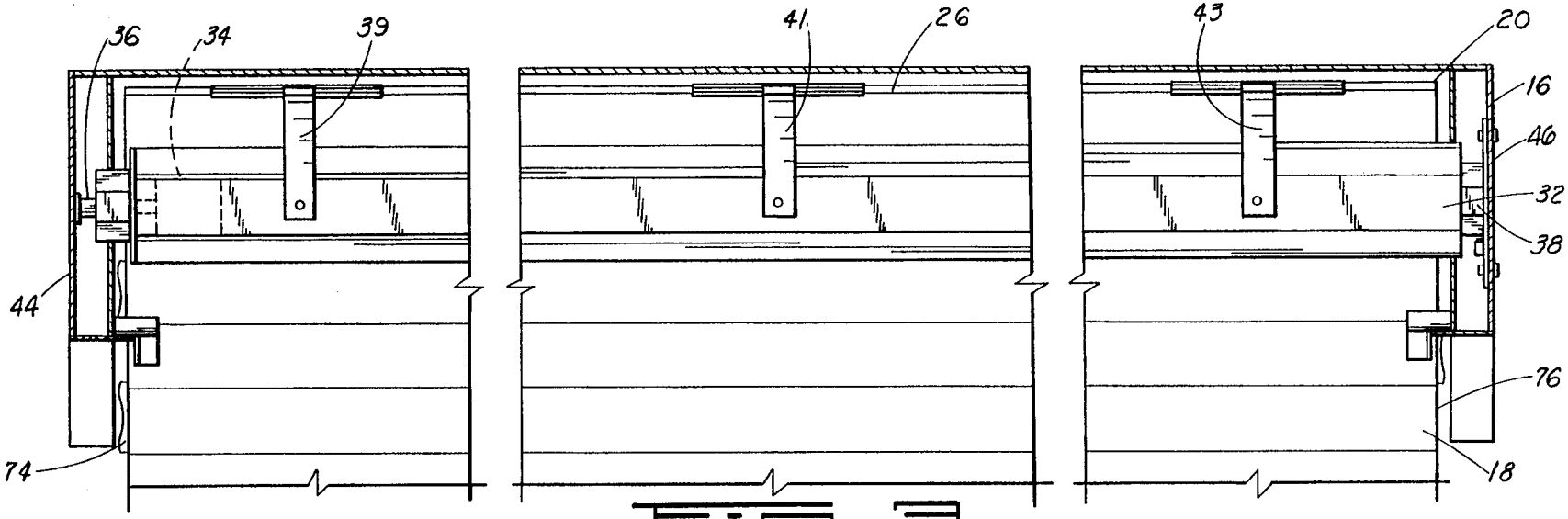
FIG. 3 is a sectional view of a case of the display shown in FIGS. 1 and 2 showing a panel extended to the display position, only a portion of the panel being shown in FIG. 3.
Figure 4:
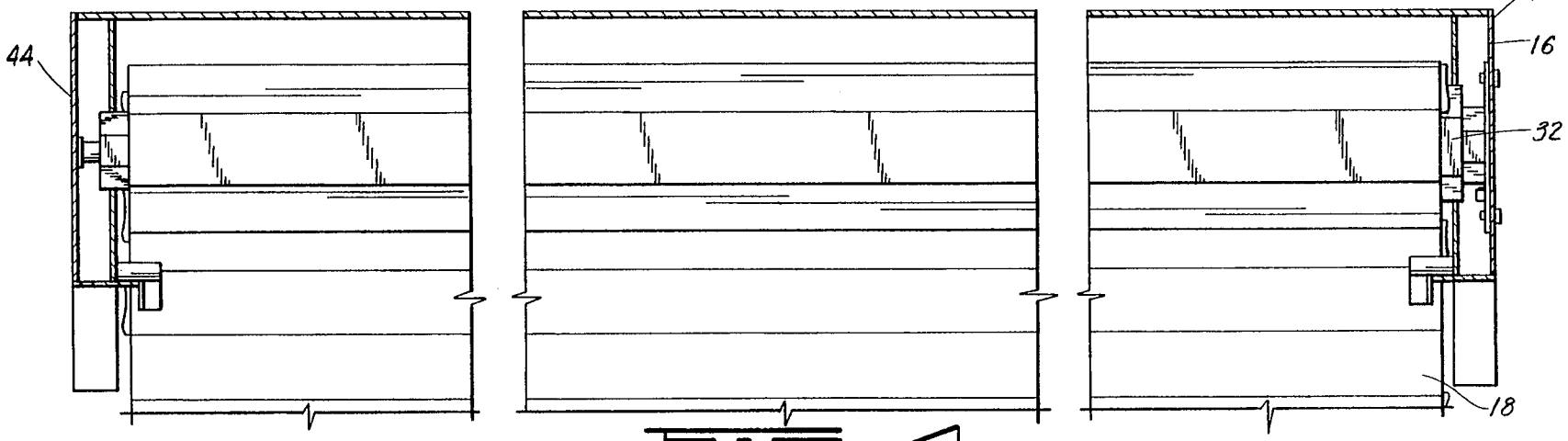
FIG. 4 is a sectional view similar to FIG. 3, but showing the panel partially moved to a storage position, only a portion of the panel being shown in FIG. 4.
Figure 5:
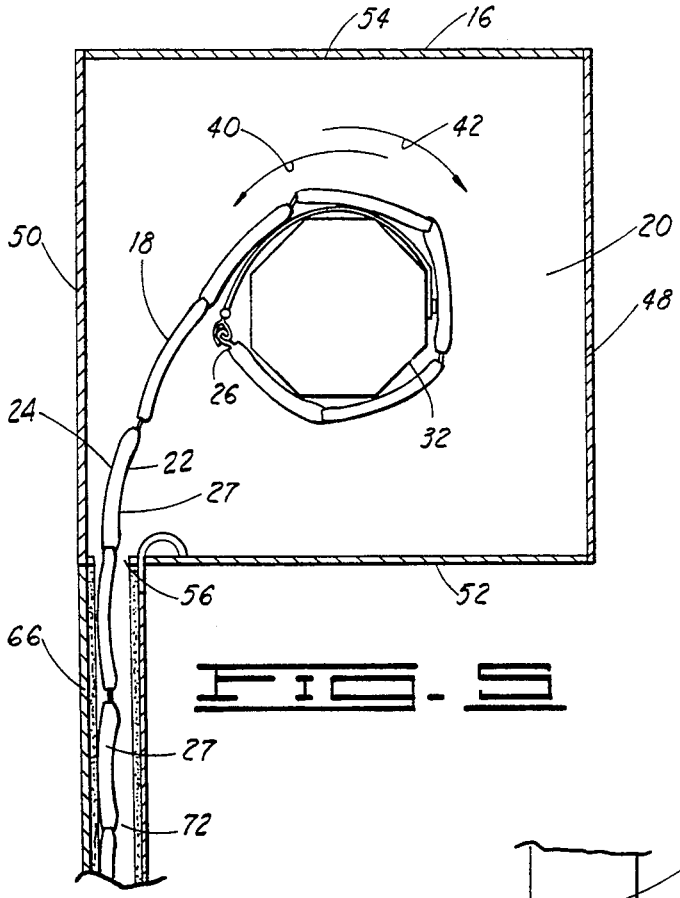
FIG. 5 is a sectional view of the case shown in FIGS. 3 and 4 taken about midway between the opposite ends of the case.
Figure 8:
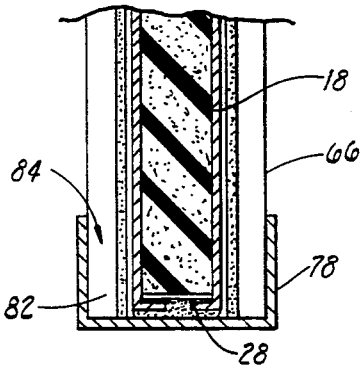
FIG. 8 is a sectional view taken substantially along the lines 8—8 of FIG. 2.

As shown in FIGS. 1 and 2, the display includes a case 16 and a flexible panel 18. The case 16 encompasses a component space 20 (FIGS. 3, 4 and 5). The flexible panel 18 has an upper surface 22, a lower surface 24 (FIG. 5), a first end 26 (FIGS. 3 and 5) and a second end 28 (FIG. 8). House number indicia 29 are disposed on the upper surface 22 of the panel 18.

The panel 18, in one form, comprises a plurality of panel members 27 (only some of the panel members 27 being designated with the reference numeral in FIG. 2). Each of the panel members 27 are interconnected so that each panel member 27 is movably and pivotally connected to the adjacent panel members 27. Panels which have interconnected panel members like that described before with respect to the panel 18 and the panel numbers 27 are commercially available from American Germany Industries, Inc. and sold under their tradename, ROLLADEN.

The case 16 is connected to the roof 12 of the house structure 14 by way of a bolt and bracket 30 (FIG. 1). Only one bolt and bracket 30 is shown in FIG. 1. A similar bolt and bracket is connected to the opposite side of the case 16 and connected to the roof 12. The case 16 also can be connected to the roof 12 by way of bolts extending through the bottom of the case 16 and through portions of the roof 12.

A shaft 32 (FIGS. 3, 4, 5 and 9) is rotatingly supported in the components space 20. The shaft 32 is hollow.

A motor 34 (FIGS. 3 and 9) is disposed in the hollow portion of the shaft 32. The motor 34 is secured to the shaft 32. The motor 34 has an output shaft 36 (FIG. 3) which extends a distance from the motor 34 and from one end of the shaft 32, the motor output shaft 36 being secured to the case 16.

A shaft 38 (FIG. 3) is secured to the case 16 and the shaft 38 extends a distance from the case 16 into the hollow portion of the shaft 32. The shaft 38 is connected to the shaft 32.

When the motor 34 is drivingly activated, the motor 34 will be rotated in a first direction 40 (FIG. 5) or in a second direction 42 (FIG. 5) thereby drivingly rotating the shaft 32 in the first direction 40 or the second direction 42 during operation of the display 10, for reasons which will be made more apparent below.

Figure 7:
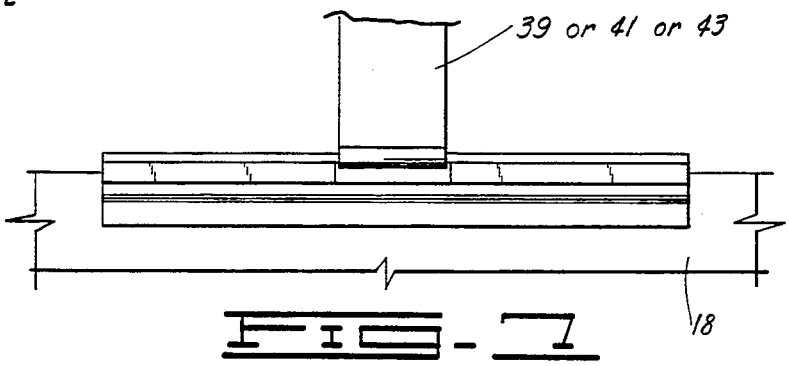
FIG. 7 is an enlarged view showing a portion of a strap connected to a portion of the panel, only a portion of the strap and only a portion of the panel being shown in FIG. 7.

The first end 26 of the panel 18 more particularly is connected to the shaft 34 by way of straps 39, 41 and 43, as shown in FIGS. 3 and 7.

The case 16 is rectangularly shaped and has a first end 44 (FIGS. 2, 3 and 4), a second end 46 (FIGS. 2, 3 and 4), a top 48 (FIGS. 2 and 5), a bottom 50 (FIG. 5), a front 52 (FIGS. 2 and 5) and a back 54 (FIGS. 2 and 5). The shaft 32 more particularly extends between the first and the second ends 44 and 46 of the case 16. A panel opening 56 (FIG. 5) is formed through the front 52 of the case 16 and the panel 18 extends through the panel opening 56 and is extendible a distance from the front 52 of the case 16.

Figure 6:
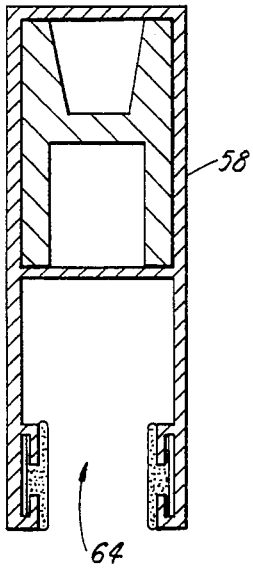
FIG. 6 is a sectional view taken substantially along the lines 6—6 of FIG. 2.

The display 10 includes a first guide bar 58 (FIGS. 2 and 6) having a first end 60 (FIG. 2) and a second end 62 (FIG. 2). A panel channel 64 (FIG. 6) is formed in the first guide bar 58 with the panel channel 64 extending generally between the first and the second ends 60 and 62. The first end 60 of the first guide bar 58 is connected to the case 16 generally near the first end 44 of the case 16. The first guide bar 58 extends a distance from the front 52 of the case 16.

The display 10 also includes a second guide bar 66 (FIGS. 2 and 5) having a first end 68 (FIG. 2) and a second end 70 (FIG. 2). A panel channel 72 (FIG. 5) is formed in the second guide bar 66. The first end 68 of the second guide bar 66 is connected to the case 16 generally near the second end 46 of the case 16. The second guide bar 66 extends a distance from the front 52 of the case 16. The second guide bar 66 extends generally parallel to the first guide bar 58 and the second guide bar 66 is spaced a distance from the first guide bar 58.

The first and the second guide bars 58 and 66 are oriented such that the panel channel 64 and the first guide bar 58 faces the panel channel 72 in the second guide bar 66. The panel 18 also has a first side 74 (FIG. 3) and a second side 76 (FIG. 3). The first side 74 of the panel 18 is slidingly disposed in the panel channel 64 of the first guide bar 58 and the second side 76 of the panel 18 is slidingly disposed in the panel channel 72 of the second guide bar 66. The panel 18 is slidingly and retainingly held in the panel channels 64 and 72 of the first and the second guide bars 58 and 66 with the first and the second guide bars 58 and 66 cooperating to slidingly and retainingly guide the panel 18.

The display 10 also includes an end bar 78 (FIGS. 2 and 8). The end bar 78 has a first end 80 (FIG. 2) and a second end 82 (FIG. 2). A panel channel 84 (FIG. 8) is formed in the end bar 78. The first end 80 of the end bar 78 is connected to the second end 62 of the first guide bar 58 and the second end 82 of the end bar 78 is connected to the second end 70 of the second guide bar 66. The end bar 78 is oriented so that the second end 28 of the panel 18 is removably disposed in the panel channel 84 when the panel 18 is fully extended from the case 16.

Figure 9:
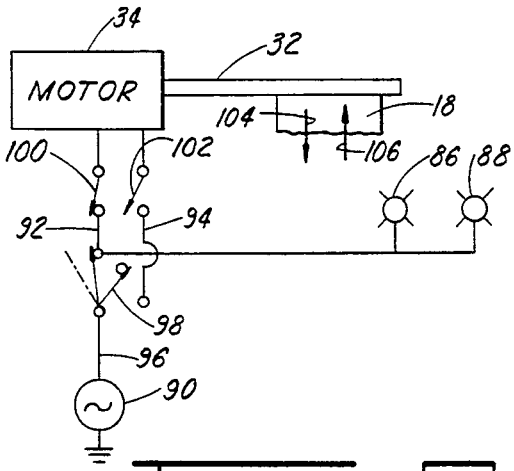
FIG. 9 is a schematic view of the display of FIGS. 1 and 2.

As shown in FIGS. 1, 2 and 9, two flashing lights 86 and 88 are connected to the top 48 of the case 16.

As shown in FIG. 9, the motor 34 is connected to an electrical power supply 90 by way of either a conductor 92 or a conductor 94 and a conductor 96. A switch 98 is interposed between the conductors 92 and 94 and the conductor 96. The switch 98 has an off position (shown in solid lines in FIG. 9). The switch 98 has two other positions, one position wherein the switch 98 connects the electrical power supply 90 to the motor 34 by way of the conductor 92 and one other position wherein the switch 98 connects the motor 34 to the electrical power supply 90 by way of the conductor 94.

When the motor 34 is connected to the electrical power supply 90 by way of the conductor 92, the motor 34 is activated to cause the shaft 38 to be rotated in the first direction 40 and, when the motor 34 is connected to the electrical power supply by way of the conductor 94, the motor 34 is activated to rotate the shaft 32 in the second direction 42. When the motor 34 is connected to the power supply 90 by way of the conductors 92 and 96 for moving the panel 18 from the storage position to a display position, the flashing lights 86 and 88 also are connected to the power supply 90 for outputting a visually observable light indication.

A limit switch 100 is interposed in the conductor 92 and a limit switch 102 is interposed in the conductor 94. The limit switches 100 and 102 are positioned on the case 16 for being activated by the movement of the panel 18 in a manner to be described below.

In operation and assuming the panel 18 has been completely rolled onto the shaft 32, thereby positioning the panel 18 in a storage position, the switch 98 is moved to the position connecting the motor 34 to the power supply 90 by way of the conductors 92 and 96. In this position, the motor 34 is activate to rotate the shaft 32 in the first direction 40 thereby causing the panel 18 to be unrolled from the shaft 32 and moved in a direction 104 (FIG. 2 and 9) from the storage position toward a display position. The motor 34 continues to drive the panel 18 in the direction 104 until the second end 28 of the panel 18 is moved into the panel channel 84 of the end bar 78 and the panel 18 has been fully extended from the case 16 and moved to the display position (FIGS. 1 and 2). As the panel 18 is moved in the direction 104, the sides of the panel 18 are slidingly moved through the panel channels 64 and 72 of the first and the second guide bars 58 and 66.

When the panel 18 has been moved to the display position wherein the second end 28 of the panel 18 is disposed in the panel channel 84 of the end bar 78, a portion of the panel 18 engages and opens the limit switch 100 and closes the limit switch 102. In the display position of the panel 18, the house number indicia 29 on the panel 18 is visible from a position above the roof 12.

If it is desired to move the panel 18 from the display position to a storage position wherein the panel 18 is completely rolled on the shaft 32, the switch 98 is moved to the position wherein the motor 34 is connected to the power supply 90 by way of the conductors 94 and 96. When the motor 34 is connected to the power supply 90 by way of the conductors 94 and 96, the motor 34 is conditioned to rotatingly drive the shaft 32 in the second direction 42 thereby moving the panel 18 in a direction 106 (FIG. 2 and 9) from the display position toward the storage position of the panel 18. The motor 34 continues to rotatingly drive the shaft 32 in the second direction 42 until the panel 18 has been completely rolled onto the shaft 32 thereby positioning the panel 18 in the storage position wherein the house number indicia 29 is not visible. When the panel 18 is moved to the storage position, a portion of the panel 18 engages the limit switches 100 and 102 and opens the limit switch 102 and closes the limit switch 100.

Changes may be made in the construction and the operation of the various components, elements and assemblies described herein without departing from the spirit and scope of the invention as defined in the following claims.

What is claimed is:

1. A method for displaying a house number indicia on a roof of a house structure, comprising the steps of:

providing a display comprising:

a case having a panel opening; and a panel having an upper surface and a lower surface, the house number indicia being disposed on the upper surface of the panel, the panel being extendible through the panel opening in the case; and connecting the display to the roof so that the house number indicia are visible from a position above the roof of the house structure.

2. A method for displaying a house number indicia on a roof of a house structure, comprising the steps of:

providing a display comprising:

a case having a panel opening;

a panel having an upper surface and a lower surface, the house number indicia being disposed on the upper surface of the panel, the panel being extendible through the panel opening in the case; and means for concealing the panel so that the house number indicia are hidden from sight and for exposing the panel so that the house number indicia are visible;

connecting the display to the roof;

concealing the panel in one mode of operation so that the house number indicia are hidden from sight; and exposing the panel in one other mode of operation so that the house number indicia are visible from a position above the roof of the house structure.

* * * * *